United States Patent [19]

Veldhoen

[11] Patent Number: 4,475,325

[45] Date of Patent: Oct. 9, 1984

[54] ASSEMBLY FOR FIXING WALL PANELS TO A REARWARDLY POSITIONED SUPPORT STRUCTURE AND A METHOD FOR FIXING WALL PANELS TO SUCH SUPPORT STRUCTURE BY MEANS OF THIS ASSEMBLY

[76] Inventor: Jan H. Veldhoen, Binnenweg 39, 7391 GL, Twello, Netherlands

[21] Appl. No.: 354,931

[22] Filed: Mar. 5, 1982

[30] Foreign Application Priority Data

Mar. 9, 1981 [NL] Netherlands ..... 8101131

[51] Int. Cl.[3] ..... E04H 1/00

[52] U.S. Cl. ..... 52/235; 52/464; 52/468; 52/489; 52/747

[58] Field of Search ..... 52/461, 464, 465, 235, 52/410, 489, 468, 483, 484, 747

[56] References Cited

U.S. PATENT DOCUMENTS

| | | | |
|---|---|---|---|
| 140,582 | 7/1873 | Leonard | 52/465 |
| 1,227,666 | 5/1917 | Rau | 52/483 |
| 1,292,509 | 1/1919 | Patterson | 52/483 |
| 1,599,255 | 9/1926 | Sparrow | 52/483 |
| 1,650,117 | 11/1927 | Dorn | 52/483 |
| 1,683,364 | 9/1928 | Loucks | 52/483 |
| 1,711,415 | 4/1929 | Lane | 52/483 |
| 2,219,714 | 10/1940 | Sperry | 52/489 |
| 2,559,051 | 7/1951 | Van Hulst | 52/489 |
| 3,016,998 | 1/1962 | Buchmeier | 52/461 |
| 3,372,520 | 3/1968 | Hensel | 52/483 |
| 4,099,355 | 7/1978 | Strunk | 52/461 |

FOREIGN PATENT DOCUMENTS 27539 of 1911 United Kingdom ..... 52/464

*Primary Examiner*—John E. Murtagh
*Assistant Examiner*—Michael Safavi
*Attorney, Agent, or Firm*—Kane, Dalsimer, Kane, Sullivan and Kurucz

[57] ABSTRACT

An assembly for fixing wall panels to a rearwardly positioned support structure, including a plurality of support rails having their longitudinal extent directed perpendicularly to that of the wall panels, and a method for fixing wall panels to such support structure by means of this assembly. This assembly comprises a jointing strip having substantially the same length as the wall panels and including a front wall and two wall portions of substantially U-shaped cross-section, said wall portions being disposed behind the front wall, said wall portions being spaced from each other and oppositely directed with respect to each other, said wall portions being adapted for receiving projecting front edge portions of adjacent wall panels so as to form an intermediate joint between said wall panels; a plurality of short fixing clamps slidably disposed in the jointing strip and including a hole; a bolt for each fixing clamp, said bolt having a nut cooperating therewith, said bolt being adapted to be inserted through the hole in the fixing clamp, said bolt being dimensioned so as to traverse the joint between the adjacent wall panels; and a bracket for each of said bolts, said bracket having an eye for the passage of the bolt, said bracket being adapted to be connected to a support rail of the support structure.

10 Claims, 8 Drawing Figures

ASSEMBLY FOR FIXING WALL PANELS TO A REARWARDLY POSITIONED SUPPORT STRUCTURE AND A METHOD FOR FIXING WALL PANELS TO SUCH SUPPORT STRUCTURE BY MEANS OF THIS ASSEMBLY

BACKGROUND OF THE INVENTION

The invention relates to an assembly for fixing wall panels to a rearwardly positioned support structure, including a plurality of support rails having their longitudinal extent directed perpendicularly to that of the wall panels, and to a method for fixing wall panels to such support structure by means of this assembly.

In a known embodiment of such assembly frog plates are pressed with one end to a flange of a support rail and with the other end to the rear face of the respective wall panel in order to establish a connection under employment of considerable force by means of bolts passing through the wall panels.

This manner of fixing has the disadvantage that the frog plates can deflect the rear face of the wall panels and even serious damages of the rear face of the wall panels can be caused due to differences in expansion and contraction, respectively, between the wall panels and the frog plates. Also, there is a danger that the frog plates will deflect by the great forces applied thereto, whereby the fixation of the wall panels to the support structure is impaired. A further disadvantage is that there are practically no possibilities for adjusting the frog plates, so that the holes in the wall panels for the passage of the bolts have to be drilled with great accuracy on the building site.

SUMMARY OF THE INVENTION

The invention has the object of providing an assembly of the kind indicated above, which has been designed to efficiently remove the said disadvantages and to obtain a better fixation of the wall panels to the rearwardly positioned support structure.

For this purpose, the assembly according to the invention is characterized by a jointing strip having substantially the same length as the wall panels and including a front wall and two wall portions of substantially U-shaped cross-section, said wall portions being disposed behind the front wall, said wall portions being spaced from each other and oppositely directed with respect to each other, said wall portions being adapted for receiving projecting front edge portions of adjacent wall panels so as to form an intermediate joint between said wall panels; by a plurality of short fixing clamps slidably disposed in the jointing strip and including a hole; by a bolt for each fixing clamp, said bolt having a nut cooperating therewith, said bolt being adapted to be inserted through the hole in the fixing clamp, said bolt being dimensioned so as to traverse the joint between the adjacent wall panels; and by a bracket for each of said bolts, said bracket having an eye for the passage of the bolt, said bracket being adapted to be connected to a support rail of the support structure.

According to the invention the fixing assembly extending through the joint between adjacent wall panels does no longer contact the rear face of the wall panels, so that there is no longer any danger of damaging this rear face.

Since the fixing clamps together with the bolts and the brackets during mounting are slidable in a direction perpendicular to the longitudinal extent of the support rails of the support structure, an engagement between the brackets and these support rails can always be established in a very quick and simple manner.

The connection between adjacent panels should be such as to prevent rearward ingression of humidity and water vapour.

For this purpose, a preferred embodiment of the assembly according to the invention is characterized by elastic sealing gaskets of rubber or the like, said gaskets having substantially the same length as the wall panels and being adapted to be clamped between the jointing strip and the front side of the adjacent wall panels.

The invention further relates to a jointing strip, a fixing clamp and a bracket, adapted for use with the assembly according to the invention.

The invention further relates to a wall panel formed as a sandwich panel and comprising a front skin, a rear skin and an intermediate synthetic foam layer, adapted to be fixed to a rearwardly positioned support structure including a plurality of support rails having their longitudinal extent directed perpendicularly to that of the wall panel, by means of the assembly described hereinbefore.

This wall panel according to the invention is characterized in that two opposite edges of the front skin project with respect to the synthetic foam layer.

For this purpose a recess in the synthetic foam layer may be formed behind both projecting edges of the front skin.

Furthermore, in an advantageous manner, the projecting edges of the front skin may constitute the ends of rearwardly off-set edge portions which are smoothly finished at the front side.

Thereby it is achieved that the elastic sealing gaskets obtain a shielded position and that the compression forces which are applied thereto and determine the sealing action can be very accurately defined.

The invention finally relates to a method for fixing wall panels to a rearwardly positioned support structure including a plurality of support rails having their longitudinal extent directed perpendicularly to that of the wall panels, by using the assembly described hereinbefore.

This method according to the invention is characterized in that a jointing strip is put together with a number of fixing clamps corresponding with the number of support rails of the support structure and with the associated bolts and the brackets, and thereafter the jointing strip is disposed with one of its substantially U-shaped wall portions on a projecting front edge portion of a wall panel which bears with its rear side against the support rails of the support structure, and the brackets are engaged with the support rails of the support structure, and thereafter a successive wall panel with a projecting front edge portion is inserted in the other, substantially U-shaped wall portion of the said jointing strip and with its rear side is positioned against the support rails of the support structure, and subsequently the nuts of the bolts are tightened from the rear side.

Hereafter the elastic sealing gaskets may be clamped between the jointing strip and the front side of the adjacent wall panels.

Furthermore, a fitting filler mass may be disposed in the joint between the adjacent wall panels.

BRIEF DESCRIPTION OF THE DRAWINGS

The invention will be explained hereinafter with reference to the drawings illustrating an embodiment of the fixing assembly according to the invention.

DESCRIPTION OF A PREFERRED EMBODIMENT

Figure 3:
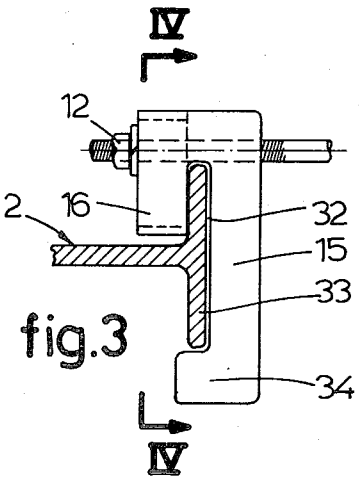
FIG. 3 is a section along the plane III—III in FIG. 1.
Figure 4:
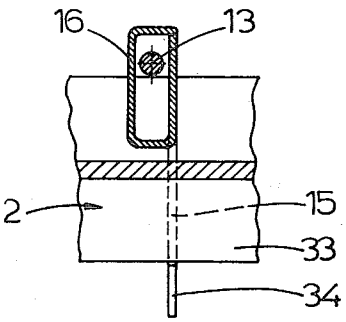
FIG. 4 is a section along the plane IV—IV in FIG. 3.
Figure 1:
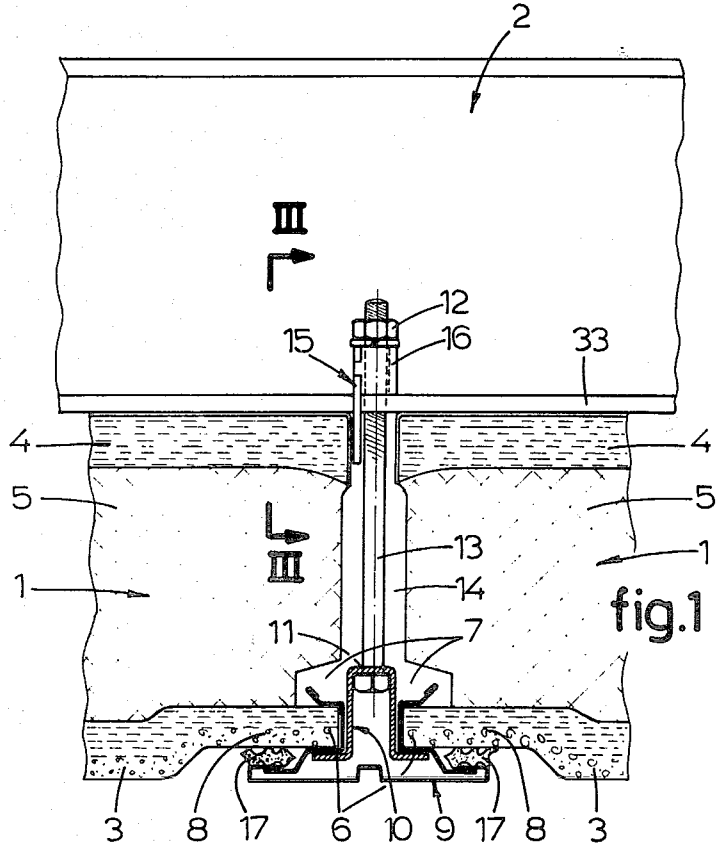
FIG. 1 is a horizontal section of portions of adjacent wall panels which are fixed to a rearwardly positioned support structure by a fixing assembly according to the invention.

FIG. 1 shows the fixation of two adjacent upright wall panels 1 to a rearwardly positioned support structure generally consisting in a simple steel framework and including, in the embodiment illustrated in the drawing, a plurality of horizontal support rails 2.

These wall panels 1 according to FIG. 1 are made as sandwich panels consisting of a front skin 3 and a rear skin 4 with a synthetic foam layer 5 interposed therebetween.

The front skin 3, for example, can be made of glass-fibre reinforced concrete finished with washed-out gravel, polyvinylchloride or the like.

The rear skin 4, for example, can be made of glass-fibre reinforced concrete finished with polyvinylchloride, epoxy resin or the like.

The intermediate synthetic foam layer 5 may consist of P.I.R. foam (Poly-isocyanurate foam) or the like.

The wall panels 1 extend along the entire height of the building so as to avoid horizontal joints.

As can be seen in the drawing, both side edges 6 of the front skin 3 of each wall panel 1 project with respect to the synthetic foam layer 5, since behind each of both projecting side edges 6 of the front skin 3 an upright recess 7 extending along the entire height has been formed in the synthetic foam layer 5.

Furthermore, both projecting side edges 6 of the front skin 3 of each wall panel 1 constitute the ends of edge portions 8 of the front skin 3, said edge portions 8 at the front side being smoothly finished and being rearwardly off-set along the entire height.

For fixing the wall panels 1 in accordance with the invention use is made, in the first place, of a jointing strip 9 having substantially the same height as the wall panels 1.

Furthermore, the fixing assembly of the invention includes a plurality of short fixing clamps 10 adapted to be slidably received in the jointing strip 9, said clamps including a hole 11. Through this hole 11 a bolt 13 can be passed cooperating with a nut 12, the bolt 13 being dimensioned so as to traverse the joint 14 between the adjacent wall panels 1.

Each bolt 13 can mount a bracket 15 including an eye 16 adapted for the passage of the bolt 13, the bracket 15 being adapted to be connected to a horizontal support rail 2 of the support structure.

Furthermore, the embodiment illustrated in the drawing shows the use of elastic sealing gaskets 17 made of rubber or similar material and having substantially the same height as the wall panels 1 and being adapted to be clamped between the jointing strip 9 and the front side of the adjacent wall panels 1.

Figure 2:
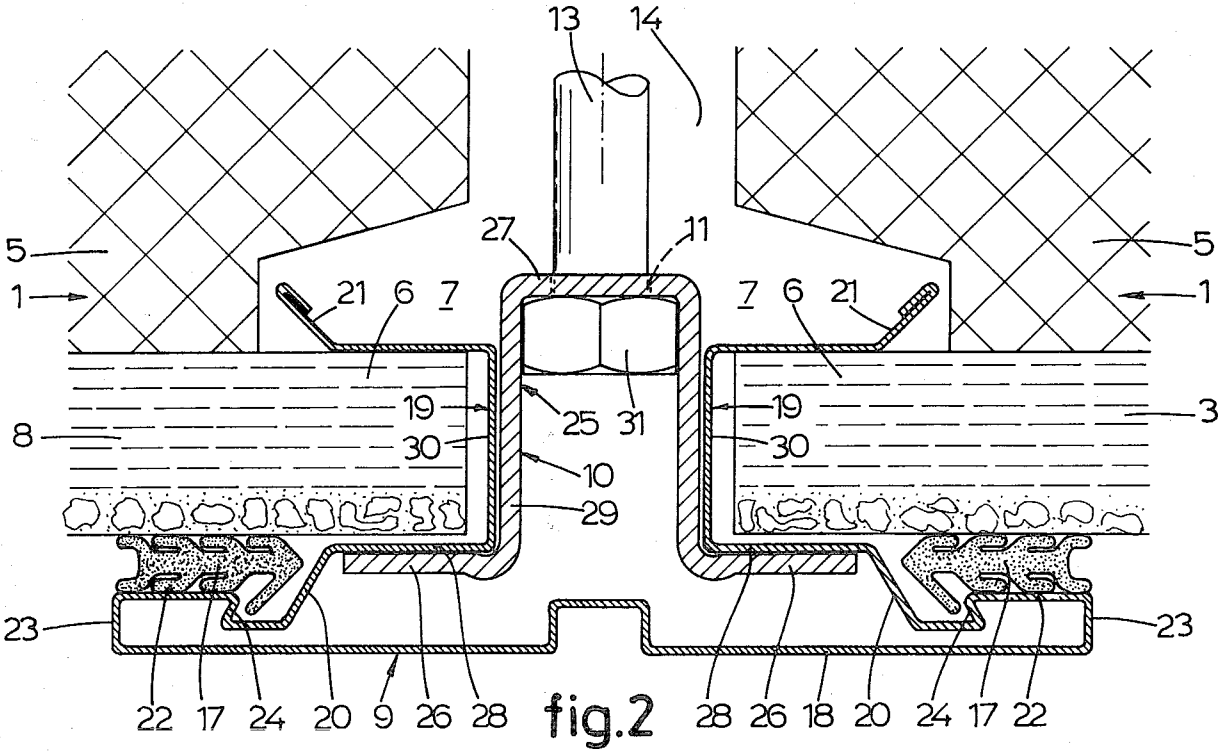
FIG. 2 shows a portion of FIG. 1 in an enlarged scale.

As appears from FIGS. 1 and 2, the jointing strip 9 includes a front wall 18 and, positioned rearwardly thereof, two wall portions 19 of substantially U-shaped cross-section, said wall portions 19 being spaced from each other and oppositely directed with respect to each other, said wall portions 19 receiving the projecting upright side edges 6 of the front skins 5 of the adjacent wall panels 1, an intermediate joint 14 being left clear between these wall panels 1.

Each of the U-shaped wall portions 19 of the jointing strip 9, at one side, joins a front entry wall portion 20 and, on the other side, joins a rear entry end edge 21, said wall portion 20 and end edge 21 diverging with respect to each other.

Both front entry wall portions 20 each are connected to the front wall 18 of the jointing strip 9 by means of a lateral confining wall portion 22 extending parallel to the front wall 18 and of the respective side edge 23 extending perpendicularly thereto.

Each confining wall portion 22 in the embodiment illustrated in the drawing serves as the front confinement of the respective elastic sealing gasket 17 and includes an undercut 24 for retaining the respective elastic sealing gasket 17. The rear confinement of the elastic sealing gaskets 17 is effected by the smoothly finished front side of the rearwardly off-set edge portions 8 of the front skin 3 of the wall panels 1.

These elastic sealing gaskets 17, in spite of occasional activity of the wall panels 1 under the influence of humidity or temperature change, efficiently prevent the rearward ingression of humidity and water vapour, respectively.

As an alternative for the use of the elastic sealing gaskets 17 it is also possible to fill-up the respective spaces between the jointing strip 9 and the front side of the adjacent wall panels 1 by injecting a flexible sealing mass, for example, mastic or a synthetic foam mass.

The short fixing clamps 10 which are slidable in the jointing strip 9, are, in the embodiment illustrated in the drawing, omega profiles including a central wall portion 25 of U-shaped cross-section, a perpendicularly bent, laterally extending end edge 26 joining said wall portion 25 at either side. In the web 27 of the U-shaped wall portion 25 a hole 11 is formed.

The end edges 26 of the fixing clamps 10 will bear against the front legs 28 of the U-shaped wall portions 19 of the jointing strip 9, the distance between the legs 29 of the U-shaped wall portion 25 of the fixing clamp 10 being slightly smaller than the distance between the webs 30 of the U-shaped wall portions 19 of the jointing strip 9.

As appears from FIGS. 1 and 2, the U-shaped wall portion 25 of the fixing clamp 10 thus extends with minimum clearance rearwardly between the webs 30 of the U-shaped wall portions 19 of the jointing strip 9.

The head 31 of each bolt 13 which is inserted through the hole 11 in the web 27 of the fixing clamp 10, is locked against rotation by being received in the U-shaped wall portion 25 of the cooperating fixing clamp 10.

Each bracket 15 has a slot 32, which is hooked over an upright flange 33 of a support rail 2 of the support structure. Furthermore, each bracket 15 is formed with an abutment edge 34 extending perpendicularly to the slot 32 and adapted to fittingly engage under the upright flange 33 of the respective support rail 2 of the support structure.

Each bracket 15 is made of sheet metal and its eye 16 has an elongated shape and bounds the slot 32 at one side.

The described embodiment of the bracket 15 has the advantage that by reason of the abutment edge 34 the bracket 15 can never loosen itself from the upright flange 33 of the support rail 2 of the support structure.

Furthermore, a large portion of this bracket 15 is disposed in the joint 14 between the adjacent wall panels 1, so that the bracket 15 projects rearwardly only over a small length.

Figures 5, 6, 7, 8:
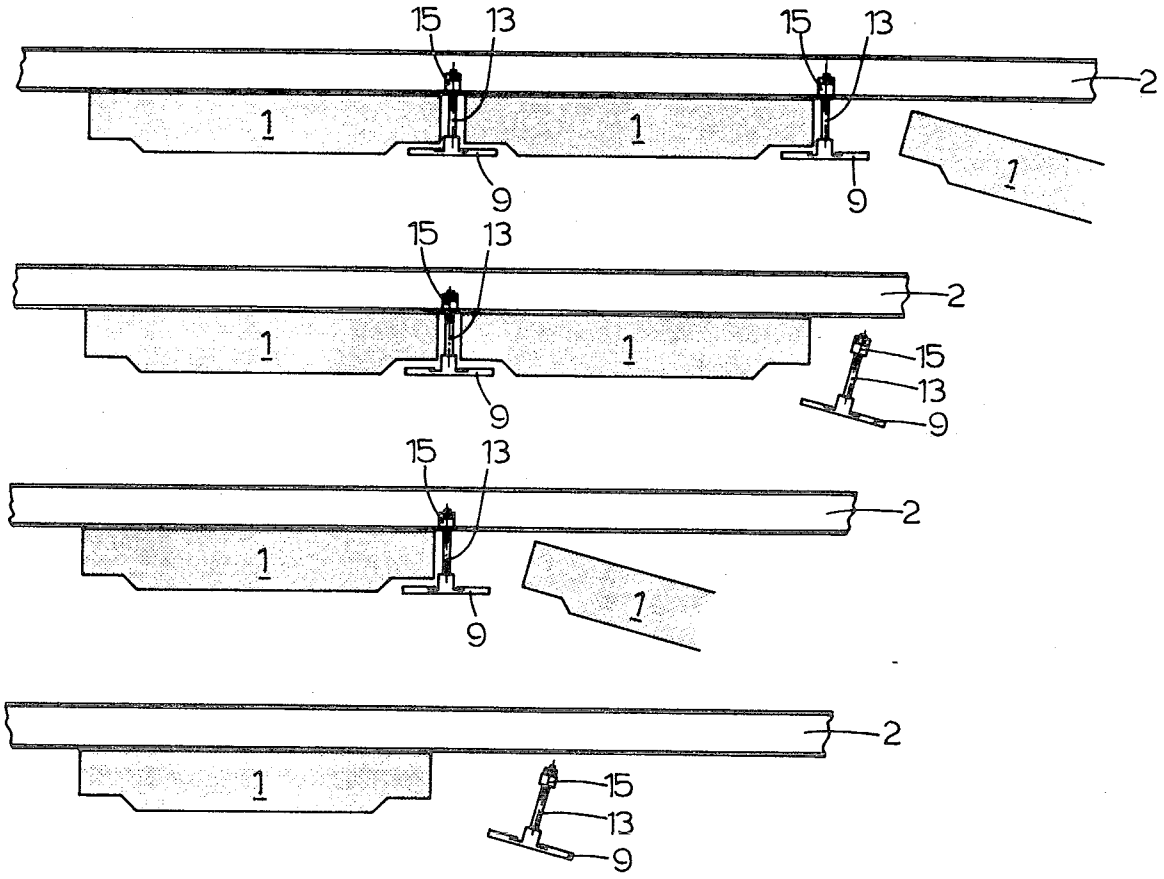
FIGS. 5–8 illustrate in a very schematic manner the successive steps for fixing adjacent wall panels to a rearwardly positioned support structure.

FIGS. 5–8 illustrate the manner of assembling the successive wall panels 1. On a wall panel 1 which has already been fixed to the support rails 2 of the support structure, a jointing strip 9 is mounted by means of the wall portion 19 which is substantially U-shaped in cross-section and is disposed on the respective side (FIG. 5). This is simplified by the entry wall portion 20 and the entry end edge 21. In the jointing strip 9 have already been disposed a number of short fixing clamps 10 corresponding with the number of support rails 2 of the support structure, each fixing clamp 10 including a bolt 13 cooperating with a nut 12 and a bracket 15 as very schematically indicated in FIG. 5.

In the operation of mounting the jointing strip 9 each bracket 15 already will be positioned to bear on the cooperating support rail 2 of the support structure, whereby the upper portion of the upright flange 33 of the respective support rail 2 will be partly received in the slot 32 of the bracket 15 and the abutment edge 34 of the bracket 15 will engage under the lower portion of the upright flange 33.

Subsequently, the successive wall panel 1 is mounted so as to bear on a masonry or concrete base and to be inserted in that U-shaped wall portion 19 of the jointing strip 9, which is directed to the respective side (FIG. 6).

Thereafter, the nuts 12 on the bolts 13 are tightened so that the wall panel 1 is made to closely bear against the support rails 2, thereby completing the fixation of the second wall panel 1 (FIG. 7).

Subsequently, in the manner described, another fixing assembly already put together is engaged with the second wall panel 1 (FIG. 8), whereafter another successive wall panel 1 can be mounted.

At a convenient moment the elastic sealing gaskets 17 can be mounted between the jointing strips 9 and the rearwardly off-set edge portions 8 of the adjacent wall panels 1.

The joints 14 between the successive wall panels 1 finally can be filled with a filler mass.

The vertical forces exercised by the wall panels 1 due to their own weight are taken up by the masonry or concrete base.

The horizontal, inwardly directed forces exercised on the wall panels 1, for example due to wind pressure, are taken up by the support rails 2 of the support structure.

On the other hand, the horizontal, outwardly directed forces exercised on the wall panels 1, for example by wind suction, are transmitted by the front skins 3 of the wall panels 1 through the jointing strips 9 to the fixing clamps 10 and therefrom through the bolts 13 and the brackets 15 to the support rails 2 of the support structure. Hereby the intermediate synthetic foam layer 5 never is directly loaded on tension.

The invention provides a fixing assembly which has the important advantage that the rear face of the wall panels 1 is not at all loaded.

Since the entire fixing assembly can be put together before mounting, the work on the building site is very simplified and errors are avoided.

The vertical expansion and contraction of the wall panels 1 under the influence of temperature and humidity can be very efficiently accommodated by the resiliency of the long shafts of the bolts 13.

Furthermore, a particularly good sealing is effected between the wall panels 1 and the jointing strips 9 by means of the elastic sealing gaskets 17.

These sealing gaskets 17 when mounted are shielded from direct sunlight influences so as to lengthen their life considerably. When these elastic sealing gaskets 17 are to be changed, this can be done in a very simple manner.

While in the embodiment illustrated in the drawing the wall panels 1 extend vertically and the support rails 2 of the support structure extend horizontally, it is of course, also possible to use horizontal wall panels 1 and in that case the support rails 2 of the rearwardly positioned support structure will extend vertically.

The invention is not restricted to the embodiment illustrated in the drawing, but various modifications may be applied thereto within the scope of the invention.

It is, for example, possible to reversely mount the bolts 13, so that the nuts cooperating therewith are received and locked against rotation by the U-shaped wall portion 25 of the cooperating fixing clamp 10.

I claim:

1. An assembly for fixing wall panels to a rearwardly positioned support structure, including a plurality of support rails having their longitudinal extent directed perpendicularly to that of the wall panels, said panels having a front skin, a rear skin and intermediate synthetic foam layer, said assembly comprising: a jointing strip having substantially the same length as the wall panels and including a front wall and two wall portions of substantially U-shaped cross-section, said wall portions being disposed behind the front wall, said wall portions being spaced from each other and oppositely directed with respect to each other, said wall portions being adapted for receiving only the front skins of adjacent wall panels; elastic sealing gaskets of rubber or the like having substantially the same length as the wall panels and being adpated to be clamped between the jointing strip and the front side of the adjacent wall panels; a plurality of short fixing clamps slidably disposed in the jointing strip and including a hole; each fixing clamp being formed as an omega profile and including a central wall portion of U-shaped cross-section, a perpendicularly bent end edge joining said wall portion at either side, said hole being formed in the web of the U-shaped wall portion, the end edges being adapted to bear against the front legs of the U-shaped wall portions of the jointing strip, the distance between the legs of the U-shaped wall portion of the fixing claim being slightly smaller than the distance between the webs of the U-shaped wall portions of the jointing strip; a bolt for each fixing clamp, said bolt having a nut cooperating therewith, said bolt being dimensioned so as to traverse the joint between the adjacent wall panels; the head or the nut of said bolt being adapted to be received in the U-shaped wall portion of the cooperating fixing clamp so as to be locked against rotation; and a bracket for each of said bolts, said bracket having an eye for the passage of the bolt, said bracket having a slot which can be hooked over a flange of a support rail of the support structure and further comprising an abutment edge extending perpendicularly to the slot and adapted to fittingly engage the end of the respective flange of the support rail of the support structure, which end is remote from the slot in the bracket.

2. An assembly as claimed in claim 1, wherein each of said U-shaped wall portions of the jointing strip is joined by a front entry wall portion and a rear entry end edge, said front entry wall portion and said rear entry end edge diverging with respect to each other.

3. An assembly as claimed in claim 2, wherein both front entry wall portions each are connected to the front wall of the jointing strip by means of a confining wall portion extending substantially parallel to the front wall, and of an edge extending substantially perpendicularly thereto.

4. An assembly as claimed in claim 3, wherein each of both confining wall portions serves as a front confinement of the respective elastic sealing gasket and includes an undercut for retaining said sealing gasket.

5. An assembly as claimed in claim 1, wherein the eye of each bracket has an elongated shape and bounds the slot at one side.

6. An assembly as claimed in claim 5, wherein each bracket is made of sheet metal.

7. An assembly as claimed in claim 1 wherein said front skin of said panels has projecting edges which are received by said wall portions and wherein behind said projecting edges of the front skin a recess is formed in the synthetic foam layer.

8. An assembly as claimed in claim 7, wherein the projecting edges of the front skin constitute the ends of rearwardly off-set edge portions which are smoothly finished at the front side.

9. A method for fixing wall panels to a rearwardly positioned support structure, including a plurality of support rails having their longitudinal extent directed perpendicularly to that of the wall panels, by using the assembly as claimed in claim 1, wherein a jointing strip is put together with a number of fixing clamps corresponding with the number of support rails of the support structure and with associated bolts and brackets, and thereafter the jointing strip is disposed with one of its substantially U-shaped wall portions on a projecting front edge portion, of a front skin only, of a wall panel which bears with its rear side against the support rails of the support structure, and the brackets are engaged with the support rails of the support structure, and thereafter a successive wall panel with a projecting front edge portion, of a front skin only, is inserted in the other, substantially U-shaped wall portion of the said jointing strip and with its rear side is positioned against the support rails of the support structure, and subsequently the nuts of the bolts are tightened from the rear side.

10. A method as claimed in claim 9, wherein elastic sealing gaskets are clamped between the jointing strip and a front side of adjacent wall panels.

* * * * *